US007404651B2

(12) United States Patent
Long et al.

(10) Patent No.: US 7,404,651 B2
(45) **Date of Patent: *Jul. 29, 2008**

(54) RENEWABLE ENERGY FLASHLIGHT

(75) Inventors: Jon Darin Long, Ogden, UT (US); Qian Tianming, Zhejiang Province (CN)

(73) Assignee: RSGA International, Inc., Ogden, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/739,443

(22) Filed: Apr. 24, 2007

(65) Prior Publication Data

US 2007/0201223 A1 Aug. 30, 2007

Related U.S. Application Data

(63) Continuation of application No. 11/199,021, filed on Aug. 8, 2005, now Pat. No. 7,232,238.

(51) Int. Cl.
*F21L 13/06* (2006.01)

(52) U.S. Cl. ..... 362/192; 362/157

(58) Field of Classification Search ..... 362/157, 362/192, 205

See application file for complete search history.

(56) References Cited

U.S. PATENT DOCUMENTS

| | | | | |
|---|---|---|---|---|
| 3,099,402 | A | 7/1963 | Speck | |
| 3,345,507 | A | 10/1967 | Messinger et al. | |
| 4,360,860 | A | 11/1982 | Johnson et al. | |
| 5,552,973 | A | 9/1996 | Hsu | |
| 5,904,414 | A | 5/1999 | Monteleone et al. | |
| 5,975,714 | A | 11/1999 | Vetorino et al. | |
| 6,220,719 | B1 * | 4/2001 | Vetorino et al. | 362/192 |
| 6,322,233 | B1 | 11/2001 | Brandt | |
| 6,729,744 | B2 | 5/2004 | Mah | |
| 6,808,288 | B2 | 10/2004 | Mah | |
| 6,893,141 | B2 | 5/2005 | Mah | |
| 7,232,238 | B2 * | 6/2007 | Long et al. | 362/192 |
| 2002/0030994 | A1 | 3/2002 | Krietzman et al. | |
| 2004/0062039 | A1 | 4/2004 | Ahn | |

* cited by examiner

*Primary Examiner*—Sandra O'Shea
*Assistant Examiner*—James W Cranson
(74) *Attorney, Agent, or Firm*—Fish & Richardson P.C.

(57) ABSTRACT

A renewable energy flashlight includes a flashlight housing, a light emitter carried by the housing, and a power source carried by the housing and powering the light emitter. The power source includes a charging magnet, at least one induction coil, and first and second repulsion members, all carried by the housing. The housing is configured to allow movement of the charging magnet between first and second positions within the housing. The induction coil carried is configured to allow movement of the charging magnet therethrough, thereby inducing current through the induction coil. Each repulsion member includes an elastic rebounding material reflexively seeded with at least one internal magnet. The first repulsion member is secured at the first position within the housing in polar opposition to the charging magnet. The second repulsion member secured at the second position within the housing in polar opposition to the charging magnet.

16 Claims, 6 Drawing Sheets

RENEWABLE ENERGY FLASHLIGHT

CROSS REFERENCE TO RELATED APPLICATION

This U.S. patent application claims priority under 35 U.S.C. §120 to a U.S. patent application filed on Aug. 8, 2005, entitled "RENEWABLE ENERGY FLASHLIGHT" and having assigned Ser. No. 11/199,021, the entire contents of which are hereby incorporated by reference.

TECHNICAL FIELD

This disclosure relates to flashlights.

BACKGROUND

A flashlight or electric torch is a hand-held portable electric spotlight used to illuminate an area. A typical flashlight includes a housing carrying a small incandescent light bulb with an associated parabolic reflector, electric batteries powering the light bulb, and an electric power switch controlling power to the light bulb.

SUMMARY

In one aspect, a renewable energy flashlight includes a flashlight housing, a light emitter carried by the housing, and a power source carried by the housing and powering the light emitter. The power source includes a charging magnet, at least one induction coil, and first and second repulsion members, all carried by the housing. The housing is configured to allow movement of the charging magnet between first and second positions within the housing. The induction coil carried is configured to allow movement of the charging magnet therethrough, thereby inducing current through the induction coil. Each repulsion member includes an elastic rebounding material reflexively seeded with at least one internal magnet. The first repulsion member is secured at the first position within the housing in polar opposition to the charging magnet. The second repulsion member secured at the second position within the housing in polar opposition to the charging magnet.

In another aspect, a renewable energy flashlight includes a main housing with an opening at one end leading into an interior chamber and a closed end. The interior chamber accommodates a cylindrical tubular carriage sized to fit and be inserted within the main housing interior chamber. The tubular carriage defines an internal transverse chamber with a first end, and a second end into which a reciprocating charging magnet is mounted. The cylindrical tubular carriage is unsealed. It has interior walls sized to fit and be inserted within the main housing interior chamber. The tubular carriage defines an internal transverse chamber with a first end, and a second end. It has air equalization passages in communication with the interior and exterior of the tubular carriage to minimize air pressure buildup and air resistance within the carriage.

Implementations of the disclosure may include one or more of the following features. In one some implementations, a plurality of holes in the tubular carriage leading into the interior chamber is placed proximate its ends to allow air to flow into and out of the tubular carriage to prevent air pressure buildup on both sides of the reciprocating magnet. A support structure is associated with the main housing and/or tubular carriage for holding electrical components such as switches, capacitors, and the light emitting diodes proximate the opening of the main housing after the tubular carriage is inserted therein. In some implementations, the end of the tubular carriage proximate the housing opening has its end formed with an open box frame for holding mounted light circuitry on a circuit board.

A charging magnet having a magnetic field is mounted within the internal transverse chamber, which is structured to hold the charging magnet for lateral traversing movement between its first and second ends. The support sliding structure affixed to the interior walls of the carriage supports the reciprocating charge magnet. It has air release structural means to minimize air pressure buildup and resistance on both sides of the reciprocating charging magnet within the transverse carriage. In some implementations, the support sliding structure includes longitudinal supports defining spaced apart grooves to enable air to pass there through to minimize air pressure buildup and resistance on both sides of the reciprocating charging magnet.

The transverse chamber is wrapped with at least one induction coil and the size of the magnet is matched to the length and depth of the copper coil for maximum inductive current creation.

A pair of elastomagnetic rebound members is opposedly mounted with one at each of the two ends of the transverse chamber. Each rebound member includes an elastic rebounding material such as rubber or silicone into which is reflexively seeded at least one internal magnet. The rebound members are mounted in polar opposition to the charging magnet to elastically and magnetically assist in rebounding there between the charging magnets. Each elastomagnetic repulsion member is void of any moving parts and employs natural reverse polarity to reduce waste in human exertion required to shake the charging magnet to power the light emitting diode. All that is needed is a simple horizontal rolling motion of the wrist. Because of the increase in the rebounding speed of the charging magnet, recharging efficiency is increased by as much as 70% thereby reducing charge time. These rebound members simultaneously eliminate the vibration stress damage on electronic components and allow the charging magnet to pass completely through the copper coil for a complete inductive cycle. As they do not employ conventional springs, they are lighter and easier to handle and not subject to spring fatigue.

The design facilitates the manual horizontal movement of the flashlight so that the magnet slides through the copper coil, and creates a natural enhanced repulsion at each end of the transfer tube to take advantage of the momentum of the magnet upon passing through the copper coil and propel its return trip to the opposite end of the transfer tube. Light emitting diode power consumption is less than that generated by gentle shaking with minimal wrist energy. The result is an efficient sealed mechanical system, which can be continuously operated with minimal human energy expense and maximum device power generation and management.

At least one induction coil is wrapped around the tubular carriage such that the charging magnet may pass completely through the induction coil during each transverse pass to induce current through the induction coil. For more rapid charging, two or more coils are employed and spaced apart sufficient for the charging magnet to sequentially pass there through to generate additional higher frequency added current from each transverse pass.

A capacitor is operably associated with the induction coil for storage of the electric current generated by the induction coil and is generally mounted on the support platform along with a light emitting diode.

Circuitry is mounted on the support structure and connected to the capacitor, the light emitting diode and the induction coil to selectively charge the capacitor in one mode and discharge the capacitor to power the diode in the other mode. After the tubular carriage and electronic components are placed with the housing, a convex magnifying lens covers and seals the opening of the housing.

For renewable flashlight embodiments used around electronic devices, the renewable energy flashlight preferably employs magnetic shielding. Magnetic shielding may be facilitated by any or all of the following:

a. Material within plastic of the housing or carriage such forming them out of high shielding efficiency (SE) doped polyaniline, polypyrrole, and polyacetylene.

b. Paint or a sprayed on material applied to the inner or outer surface of the housing or outside of the carriage, such as coating them with a paint having copper particles contained therein such as the water based paint sold under the trade name CuPro-Code™ or StaticVeil™, or the nickel-rich paint that is manufactured by Acheson Colloids.

c. A film material added to either the inside the housing or encasing the tubular carriage, such as an encasement made of Mumetal, which is an alloy of 5% Copper, 2% Chromium, 77% Nickel, and 16% Iron.

The shielding selected is dependent upon the strength of the magnets and the geometry of the components and circuitry. Coatings using polymeric magnets have the added advantage of providing decorative accents. The inherent low densities and high molecular masses of molecule/polymer-based magnets mean that bulk applications relying on high magnetic moments either on a mass or volume basis are unlikely.

The renewable energy flashlight preferably includes a concave reflective mirror surrounding the light emitting diode structured to capture and direct light through the lens to enhance the light beam. This reduces significantly the lost light through the head of the housing.

For renewable energy flashlight embodiments used around water, the components are sealed within the housing forming a water impervious flashlight. Preferably, these embodiments have a density less than water so that they can float. To maintain the vapor seal, the circuitry includes a sealed reed switch mounted to the exterior of the housing to turn the light emitting diode on and off via a reciprocating magnet.

The improved design using an unsealed tube to eliminate air pressure and frictional resistance to the reciprocating charging magnet and the employment of elastomagnetic rebound members rather than springs and dampers provides superior charging results. The force in a compression spring is found from Hooke's Law, $$F=k(L_{free}-L_{def})$$

The force for magnetic repulsion of the embodiments of the invention's renewable energy flashlights is found from Coulomb's Law $F\alpha(P1\times P2)/r2$ In words, this means that the attraction or repulsion force (F) is directly proportional to the product of magnetic pole strengths (P1, P2), and inversely proportional to the square of distance (r2) between them.

The details of one or more implementations of the disclosure are set fourth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

Figure 1:
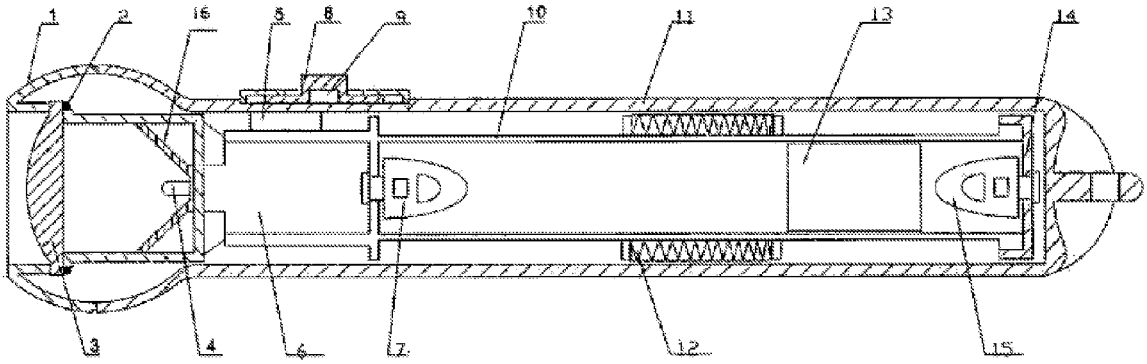
FIG. 1 is a side cross-sectional view of a renewable energy flashlight.

One implementation of the renewable energy flashlight is shown in FIG. 1, a side cross sectional view. The components shown are as follows:

1. Bezel
2. Seal
3. Beam magnifying lens
4. Light Emitting Diode (LED)
5. Sealed ferrous reed switch
6. Circuit board with capacitor
7. Seed Magnet
8. Sliding plastic switch shield
9. Switch Magnet
10. Inner tubular carriage
10*a*. Air holes
10*b*. Transport grooves
10*c*. Air passages
11. Polycarbonate outer shell housing
12. Copper induction coil
13. Charging magnet
14. Tube sealing base cap
15. Elastomagnetic rebound member
16. Reflecting bowl mirror Sealed within the renewable polycarbonate outer shell housing 11 is an inner tubular carriage 10 into which is slideably mounted a charging magnet 13. The tubular carriage 10 is not pressure sealed and has holes 10*a* proximate its ends in communication with its exterior and interior, which allow air to pass there through to prevent air pressure buildup and resistance on both sides of the reciprocating charging magnet 13.

It is surrounded by a copper coil 12, such that as the charging magnet 13 reciprocates there through an electrical current is generated, which is collected on the circuit board capacitor 6.

A pair of opposedly mounted elastomagnetic rebound members 15 is mounted on either end of the tubular carriage 10 to assist in recoiling the charging magnet 13 there between. A first elastomagnetic rebound member 15 is mounted through an end cap located inside and at said first end of the cylindrical inner tubular carriage 10 and a second elastomagnetic rebound member 15 is located inside and at said second end of said cylindrical inner tubular carriage 10. The elastomagnetic rebound member 15 is constructed of a resilient silicone material resistent to ultraviolate light for use with transparent housings 11. The rebound member 15 is embedded with at least one seed magnet 7 and sized to fit within the cylindrical inner tubular carriage 10 without contacting its walls when compressed to avoid wall interference with its recoil action. The elastomagnetic rebound member 15 shown has an air pocket cushion sealed therein just in front of the seed magnet 7. The elastomagnetic rebound members 15 are mounted such that their seed magnets are in polar opposition for natural reduction and repulsion of the charging magnet 13 as it transverses and rebounds within the cylindrical inner tubular carriage 10, which is surrounded by a single copper coil 12. The rebound silicone material of the elastomagnetic rebound members 15 is first compressed until the charging magnet is slowed and stopped in the proximity of the seeded magnet. The charging magnet 13 direction is then reversed and rebounded elastically and magnetically so that the charging magnet 13 recoils between the elastomagnetic repulsion members 15 with minimal energy loss.

In one example, the carriage 10 is structured as a ribbed cage. It has magnet support and transport grooves 1O*b* on its interior walls separated by air passages 10*c*.

The particular single coil embodiment shown in FIG. 1 has a bezel 1 with a seal 2 to secure a magnifying lens 3 over the opening in the housing 11, thereby making it impervious to water. As it only employs one coil 12 and no magnetic shielding, this embodiment has a density less than water and floats. FIG. 1 illustrates the cap 1 and lens 2 associated with an O-ring 2 seal between the light reflector assembly 16

A sealed ferrous reed switch 5 is housed within the housing 11 and is mounted upon the circuit board 6. A sliding plastic shield 8 holding a magnet 9 is mounted above said switch 5, outside the housing 11 to allow the flow of inductive current stored in the form of electric energy within said capacitor 6 and opened by moving said magnet from proximity to said switch releasing said electrical charge stored in said capacitor 6 through said circuitry to power the light emitting diode 4. This switch 5 is included to shut down the flow of electricity to the light emitting diode 4 during charging to more rapidly charge the capacitor.

A cone shaped light-reflecting bowl 16 with a central hole mounted around and behind said light emitting diode 4 is included as part of the light assembly to capture and amplify light directed through the magnifying lens 3.

Figure 2:
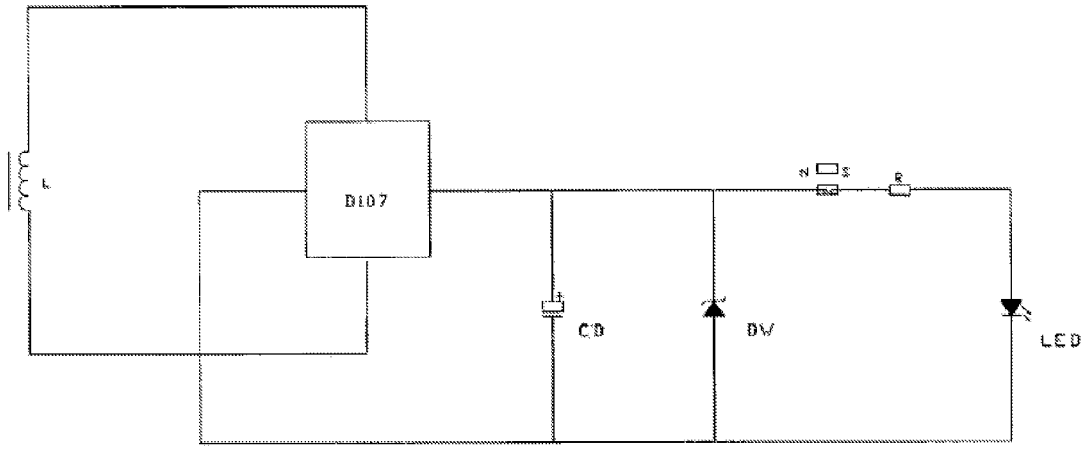
FIG. 2 is a single coil circuit schematic.

The interconnecting circuit comprises a circuit board capacitor 6 associated with a light emitting diode 4 as shown in FIGS. 1-2 to convert the copper coil 12 energization into an electrical charge with a four stage bridge AC to DC flow control rectifier system such that energy stored in the capacitor to power the light emitting diode 4.

Figure 3:
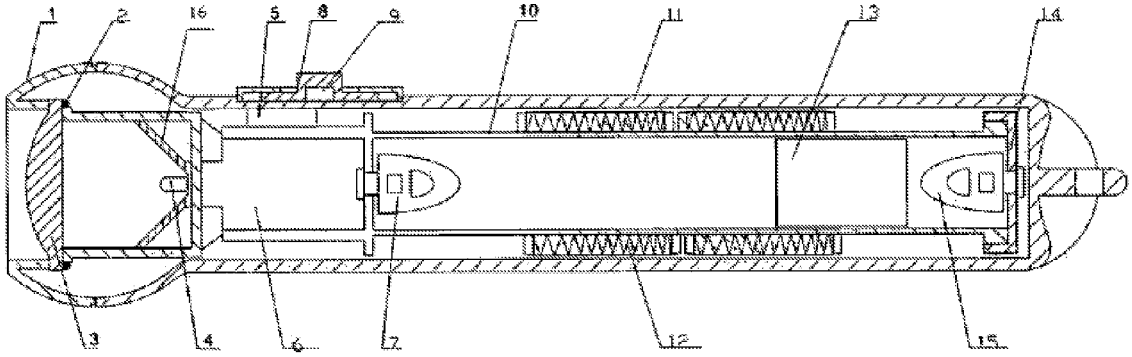
FIG. 3 is a side cross sectional view of a renewable energy flashlight.
Figure 4:
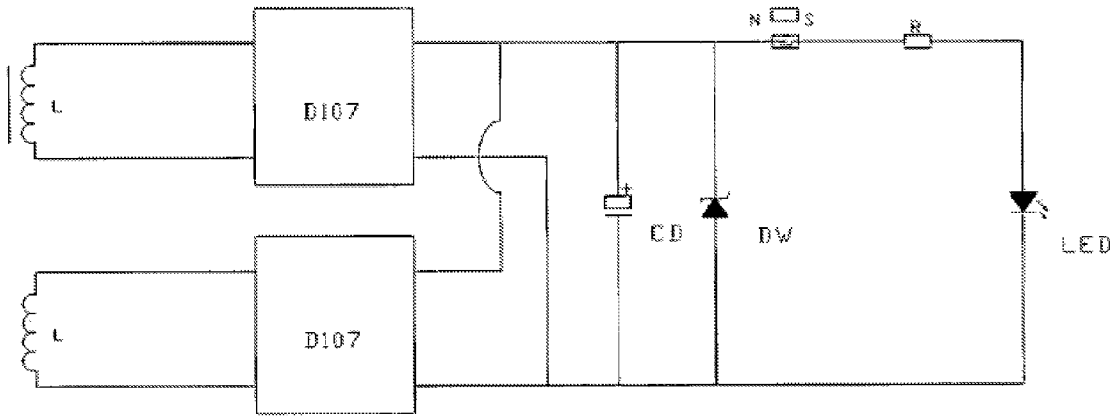
FIG. 4 is a dual coil schematic.

For faster charging, a second coil 12 is added to the embodiment of FIG. 1 as shown in FIG. 3. This dual coil 12 embodiment generates high frequency additional current for each transverse pass of the charging magnet 13. The charging circuit of the embodiment shown in FIG. 3 is shown in FIG. 4.

Figure 5:
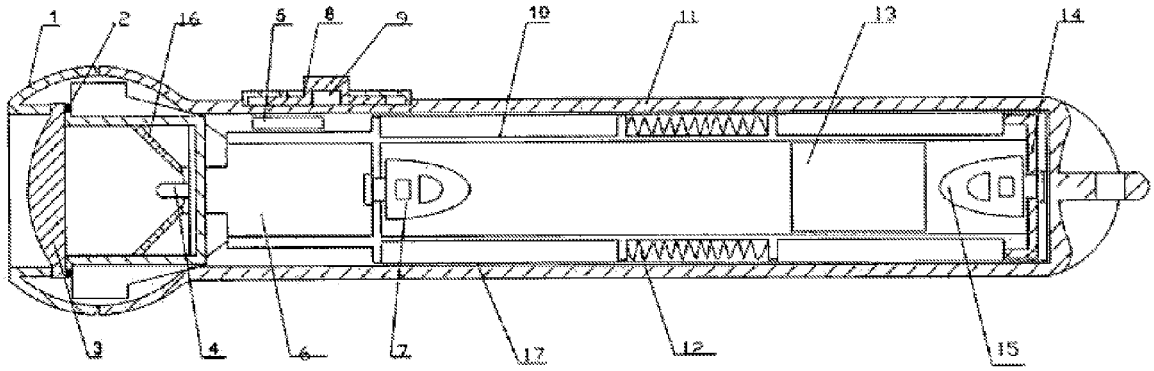
FIG. 5 is a cross section view of a housing with magnetic field suppression film.

In addition, this dual coil 12 embodiment employs a magnetic shielding lining 17 of the interior of the housing 11 to prevent interference with electronic components or other devices coming within the immediate proximity of the renewable energy flashlight as shown in FIG. 5.

Figure 6:
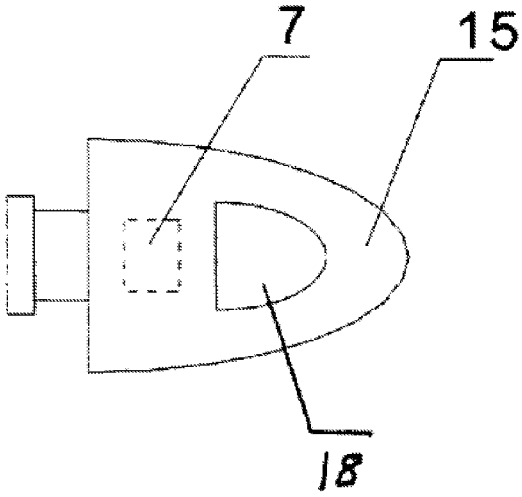
FIG. 6 is a cross section view of a rebound member.
Figure 7:
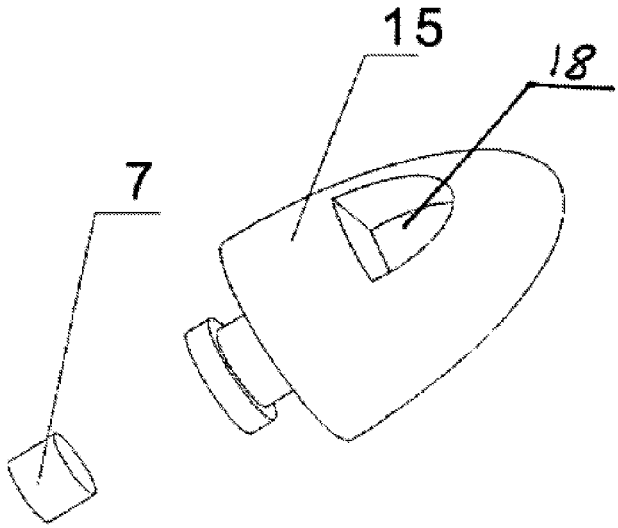
FIG. 7 is a perspective view of the rebound member of FIG. 6.

FIG. 6 a side view of the elastomagnetic rebound member 15 showing the embedded seed magnet 7 and the surrounding elastic resilient material which prevents magnet to magnet contact while providing dual electro and elastic recoil action. A hole 18 is inserted within the elastic resilient material proximate the magnet 7 to reduce its weight and assist in resilient rebound action. FIG. 7 is a perspective view of the elastomagnetic rebound member 15 of FIG. 6.

The disclosure provides a renewable energy flashlight employing a pair of elastomagnetic rebound members 15 to assist in reciprocating a charging magnet 7 passing through surrounding induction coils 12 to enhance the efficiency of manually charging a capacitor 6 to power an LED 4 lens 3 amplified flashlight.

A number of implementations have been described. Nevertheless, it will be understood that various modifications may be made without departing from the spirit and scope of the disclosure. Accordingly, other implementations are within the scope of the following claims.

What is claimed is:

1. A renewable energy flashlight comprising:

a flashlight housing;

a light emitter carried by the housing; and a power source carried by the housing and powering the light emitter, the power source comprising:

a charging magnet carried by the housing, the housing configured to allow movement of the charging magnet between first and second positions within the housing;

at least one induction coil carried by the housing and configured to allow movement of the charging magnet therethrough, thereby inducing current through the induction coil; and first and second repulsion members, each repulsion member carried by the housing and comprising an elastic rebounding material reflexively seeded with at least one internal magnet, the first repulsion member secured at the first position within the housing in polar opposition to the charging magnet, the second repulsion member secured at the second position within the housing in polar opposition to the charging magnet.

2. The renewable energy flashlight of claim 1 further comprising an energy storage device carried by the housing and in communication with the induction coil.

3. The renewable energy flashlight of claim 2 wherein the energy storage device comprises a capacitor.

4. The renewable energy flashlight of claim 2 further comprising circuitry carried by the housing and in communication with the energy storage device, the light emitter and the induction coil, the circuitry configured to selectively charge the energy storage device in a first mode and discharge the energy storage device to power the light emitter in a second mode.

5. The renewable energy flashlight of claim 4 wherein the circuitry comprises a reed switch mounted to the exterior of the housing.

6. The renewable energy flashlight of claim 1 further comprising a lens carried by the housing and covering the light emitter.

7. The renewable energy flashlight of claim 6 wherein the lens comprises a convex magnifying lens.

8. The renewable energy flashlight of claim 6 further comprising a concave reflector carried by the housing and at least partially surrounding the light emitter, the reflector configured to capture and direct light through the lens.

9. The renewable energy flashlight of claim 1 wherein the light emitter comprises a light emitting diode.

10. The renewable energy flashlight of claim 1 wherein the housing comprises:

an interior chamber defined by the housing; and a tubular carriage sized to fit and be inserted within the interior chamber, interior walls of the carriage defining a transverse chamber having first and second ends and air equalization passages in communication with the interior and exterior of the tubular carriage, the charging magnet carried in the carriage.

11. The renewable energy flashlight of claim 10 wherein the housing further comprises shielding surrounding the tubular carriage.

12. The renewable energy flashlight of claim 11 wherein the shielding comprises a magnetically impervious material.

13. The renewable energy flashlight of claim 11 wherein the shielding comprises a conductive coating applied to the interior chamber of the housing surrounding the tubular carriage.

14. The renewable energy flashlight of claim 1 wherein the components are sealed within the housing forming a water impervious flashlight.

15. The renewable energy flashlight of claim 1 wherein the flashlight has a density less than water.

16. The renewable energy flashlight of claim 1 wherein the repulsion members comprise silicone.

* * * * *